US007837070B2

(12) United States Patent
Marelli

(10) Patent No.: US 7,837,070 B2
(45) Date of Patent: Nov. 23, 2010

(54) SIMPLIFIED PUMP FOR DISPENSING FLUID SUBSTANCES WITHDRAWN FROM A CONTAINER

(75) Inventor: Andrea Marelli, Basiglio (IT)

(73) Assignee: MEADWESTVACO CALMAR S.r.l., Pieve Emanuele (IT)

( * ) Notice: Subject to any disclaimer, the term of this patent is extended or adjusted under 35 U.S.C. 154(b) by 383 days.

(21) Appl. No.: 11/765,028

(22) Filed: Jun. 19, 2007

(65) Prior Publication Data

US 2008/0000933 A1 Jan. 3, 2008

(30) Foreign Application Priority Data

Jun. 29, 2006 (IT) ..... MI2006A1266

(51) Int. Cl.
*B65D 88/54* (2006.01)

(52) U.S. Cl. ..... 222/321.7; 222/340

(58) Field of Classification Search ..... 222/321.7, 222/190, 321.9, 145.6, 321.1, 321.8, 340, 222/383.1, 402.1, 384, 341
See application file for complete search history.

(56) References Cited

U.S. PATENT DOCUMENTS

| | | | | |
|---|---|---|---|---|
| 3,229,864 | A | 1/1966 | Roder | |
| 3,877,616 | A | 4/1975 | Stevens | |
| 4,111,367 | A * | 9/1978 | Hayes | 239/333 |
| 4,371,097 | A | 2/1983 | O'Neill | |
| 5,443,569 | A * | 8/1995 | Uehira et al. | 222/190 |
| 6,332,561 | B1 | 12/2001 | Garcia et al. | |
| 7,048,153 | B2 * | 5/2006 | Gentile | 222/190 |
| 7,578,417 | B2 * | 8/2009 | Son | 222/257 |
| 2005/0115990 | A1 * | 6/2005 | Kang | 222/321.9 |
| 2008/0083783 | A1 * | 4/2008 | Nelson | 222/153.13 |
| 2008/0083784 | A1 * | 4/2008 | Foster et al. | 222/153.13 |

FOREIGN PATENT DOCUMENTS

| | | |
|---|---|---|
| EP | 0 340 724 A2 | 11/1989 |
| FR | 2 643 338 A1 | 8/1990 |

* cited by examiner

*Primary Examiner*—Lien T Ngo
(74) *Attorney, Agent, or Firm*—Oblon, Spivak, McClelland, Maier & Neustadt, L.L.P.

(57) ABSTRACT

A simplified pump for dispensing fluid substances withdrawn from a container of said substances, comprising a cup-shaped body into which a hollow stem extends, an endpiece of the cup-shaped body, said cup-shaped body presenting a passage, closable by a valve, and a seat for housing one end of a dip tube, a piston, an elastic member and a movable valve for closing the stem cavity, an elongated rod, a first end of which is inserted into and retained in a seat provided at the second end of the cup-shaped body, an intermediate portion of the rod having a cylindrical profile of diameter less than the diameter of the stem cavity into which said rod portion extends, said movable valve for closing the stem cavity comprising a continuous elastic lip projecting from a second end of the rod towards the outside of said cylindrical chamber, said lip being sealedly slidable in contact with the cylindrical surface of the stem cavity.

13 Claims, 4 Drawing Sheets

SIMPLIFIED PUMP FOR DISPENSING FLUID SUBSTANCES WITHDRAWN FROM A CONTAINER

FIELD OF THE INVENTION

The present invention relates to a pump for dispensing fluid substances withdrawn from a container. In particular it relates to a dispensing pump for fluid substances such as creams, gels or the like.

BACKGROUND OF THE INVENTION

Fluid substance dispensing pumps are known for example from U.S. Pat. No. 6,170,713. The pump described in said US document comprises a cup-shaped body closed at one end by an endpiece provided with a passage for a stem on which a movable piston is directly provided sealing against the inner surface of the cup-shaped body. The cup-shaped body comprises unidirectional valve means arranged to intercept a fluid passage provided in the base of the cup-shaped body.

A first spring is provided within the cup-shaped body to urge the piston into a rest position. The stem is provided internally with a large axial cavity housing a valving element movable against a sealing surface in opposition to a second spring. This valving element opens to enable the fluid compressed by the piston to be delivered into the cup-shaped body only when the internal fluid pressure exceeds that with which the spring holds the valving element pressed against a sealing surface provided in the stem.

DISCUSSION OF THE RELATED ART

This pump presents considerable problems. Firstly it is formed from a large number of pieces.

Consequently a large number of moulds are required, involving high initial costs. A store able to handle a large number of parts must also be available.

Moreover its assembly is extremely difficult, it being very difficult to insert the valving element into the stem.

Numerous assembly steps are therefore involved, resulting in long production times and very complicated assembly machines.

Moreover, such a pump with a large number of mutually mobile parts may be of poor reliability.

SUMMARY OF THE INVENTION

An object of the invention is to provide a simplified pump for dispensing fluid substances withdrawn from a container which is formed from a small number of parts.

Another object of the invention is to provide a dispensing pump requiring a small number of moulds for its production, and which can be produced without the need to hold a large number of parts in store.

A further object of the present invention is to provide a simplified pump which can be easily assembled by a few assembly steps and does not require complex assembly equipment.

A further object of the present invention is to provide a pump which is reliable in use.

These and further objects are attained by a simplified pump for dispensing fluid substances withdrawn from a container of said substances, comprising a cup-shaped body defining a cylindrical chamber into which a hollow stem extends, an endpiece mounted on an open first end of the cup-shaped body, said cup-shaped body presenting at its second end a passage, sealedly closable by a unidirectional valve, and a seat for housing one end of a dip tube for withdrawing the fluid substance from the container, a piston sealedly slidable along the surface of the cylindrical chamber, said piston being rigid with said stem and being disposed in proximity to a first end of the stem within said chamber and projecting towards the inner surface of the cup-shaped body, the endpiece being provided both with a hole through which said stem emerges and by which it is guided, and with at least one element sealing against said piston, an elastic member which acts in the sense of urging said piston towards said endpiece, and a movable valve for closing the stem cavity, wherein positioned in the interior of the cup-shaped body there is an elongated rod, a first end of which is inserted into and retained in a seat provided at the second end of the cup-shaped body, an intermediate portion of the rod having a cylindrical profile of diameter less than the diameter of the stem cavity into which said rod portion extends, said movable valve for closing the stem cavity comprising a continuous elastic lip projecting from a second end of the rod towards the outside of said cylindrical chamber, said lip being sealedly slidable in contact with the cylindrical surface of the stem cavity.

Advantageously the lip defines a recess at the second end of the rod, from the top of the stem there projecting a profiled element insertable into the cavity defined by the lip when the stem is totally lowered into the pump, the profiled element being substantially complementary to the cavity.

The unidirectional valve consists of a flexible discoidal piece projecting from the rod surface in proximity to the first end and of a sealing surface provided on the inner second end of the cup-shaped body, the discoidal piece preventing fluid passage under rest or dispensing conditions, the sealing surface being sharp-edged.

The unidirectional valve can also be a ball positioned between the cup-shaped body and the bottom of the rod.

Advantageously, an operating and dispensing pushbutton is fixed externally to the second end of the stem, the elastic element being positioned between the pushbutton and the endpiece and being in the form of a spring.

At its second end the stem presents a raised portion projecting into the interior of the stem cavity, the raised portion being situated in a position such as to interfere with the projecting lip in such a manner as to open the valve when the piston is pressed into its end of stroke position.

The raised portion can be replaced by a groove provided in the inner surface of the stem cavity, the groove being situated in a position such as to cooperate with the projecting lip in such a manner as to open the valve when the piston is pressed into its end of stroke position.

Alternatively, instead of the raised portion or the groove, the cup-shaped body can present at its second end, in the chamber interior, a raised portion arranged to interfere with the sliding piston such as to compromise its seal, when the piston is pressed into its end of stroke position.

Advantageously, the endpiece is integral with a ring cap enabling the pump to be fixed onto the container, the endpiece seal element being annular and acting as a sealing stop for the piston when this is in its rest position.

The stem cavity presents a conical lead-in in proximity to its first end.

BRIEF DESCRIPTION OF THE DRAWINGS

Further characteristics and advantages of the invention will be evident from the description of a preferred but non-exclusive embodiment of the dispensing pump, illustrated by way of non-limiting example in the accompanying drawings, in which.

DETAILED DESCRIPTION OF THE INVENTION

Figure 1:
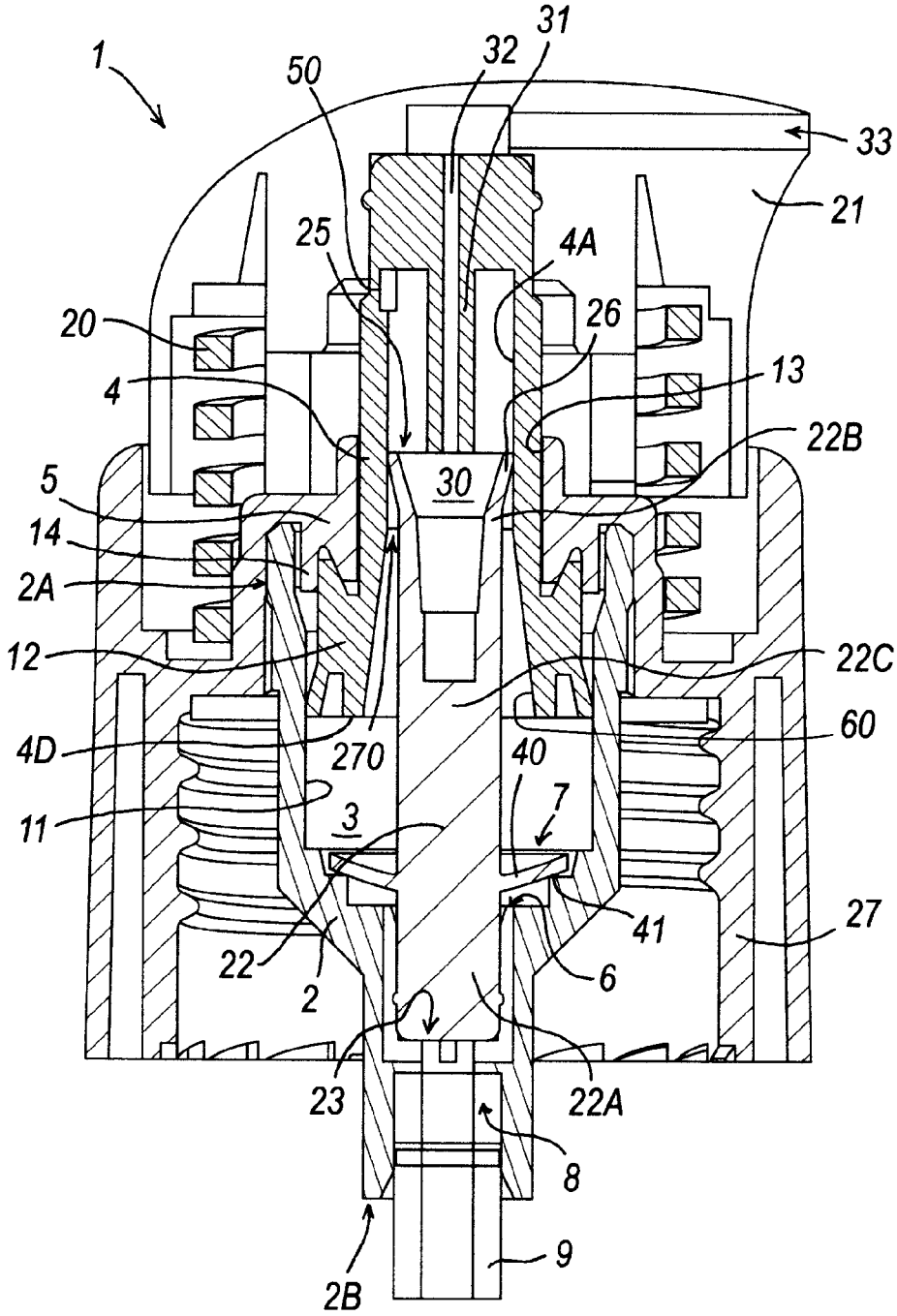
FIG. 1 is a lateral section through the pump in its rest phase.

With particular reference to the figures, these show a dispensing pump indicated by 1.

The pump comprises a cup-shaped body 2 defining a cylindrical chamber 3 into which a hollow stem 4 extends. That stem surface 4A defining the cavity presents a conical lead-in portion 60 in proximity to a first stem end. An endpiece 5 is also present mounted on an open first end 2A of the cup-shaped body 2. The endpiece is integral with a ring cap 27 for fixing to a container on which the pump is to be mounted. At its second end 2B, the cup-shaped body presents a passage 6, sealedly closable by a unidirectional valve 7. At its second end 2B, the cup-shaped body also presents a seat 8 for housing one end of a dip tube 9 for withdrawing the fluid substance from the container.

When the unidirectional valve 7 is open, the passage 6 connects the interior of the cylindrical chamber 3 to the tube 9.

The pump also comprises a piston 12 sealedly slidable on the inner surface 11 of the cylindrical chamber 3. The piston 12 is integral with the stem 4 and is hence rigid therewith.

The piston is disposed in proximity to a first end 4D of the stem 4 within the chamber 3 and projecting towards the inner surface of the cup-shaped body 3.

The endpiece 5 presents a hole 13 through which the stem 4 emerges and is guided, and also presents a seal element for the piston. This seal element 14 is of ring configuration and presents an annular groove 15 of tapered cross-section into which a corresponding upper (in FIG. 2) annular portion 16 of the piston 12 is wedged.

When the piston 12 is in its rest position, the annular portion 15 is wedged into the annular groove, the interior of the container on which the pump is fixed then being isolated from the outside. In contrast, when the piston 12 is distant from its rest position, the annular portion 16 is detached from the groove 15 to create an air passage between the outside and the inside of the container. The air is drawn into the container when this is under vacuum because of the corresponding exit of part of its contents after a certain quantity of product has been dispensed by the pump. More precisely, the path which the air takes in entering the container is well visible in FIG. 2; the air passes substantially between the stem and the stem guide element provided in the endpiece 5 to reach an intermediate chamber 160 created between the piston and endpiece. This air is then drawn through a suitable passage provided between the endpiece 5 and the outside of the cup-shaped body 2 at that region 19 in which the cup-shaped body 2 is snap-inserted into the endpiece.

The piston 12 is urged towards the endpiece into its rest position by an elastic member. In the illustrated embodiment the elastic member is a spring 20, on the second end of the stem there being mounted an operating and dispensing pushbutton 21. The spring 20 is positioned between the pushbutton and the endpiece 5 in such a manner as not to be in contact with the fluid dispensed by the pump.

However, in an alternative embodiment this spring can be positioned between a groove provided in the cup-shaped body and the piston itself. An elongated rod 22, positioned inside the cup-shaped body 2, has its first end 22A inserted into a seat 23 provided at the second end 2B of the cup-shaped body 2 and retained thereat by an undercut fit. The seat 23 presents a plurality of fins (not shown) which securely fix the rod 22. The rod comprises an intermediate cylindrical profile portion 22C of diameter less than the diameter of the stem cavity into which said rod portion extends. The cavity of the stem 4 is in communication with the outside, dispensing of the fluid substance taking place through said cavity. A movable valve 25 for closing said cavity is present in the cavity, this valve 25 comprising a continuous elastic lip 26 projecting from a second rod end 22B towards the outside of the cylindrical chamber. The lip 26 is of frusto-conical conformation, its shape being such as to create between the lip and the inner surface of the stem a wedge-shaped interstice 270 which tapers away from the cylindrical chamber 3, in the fluid dispensing direction. The lip 26 is substantially slidable (with the movement of the piston 12) in contact with and sealing against the cylindrical surface 4A of the cavity in the stem 4.

At the second end of the rod the lip 26 defines a recess 30 which, given its shape, contributes to providing the lip 26 with the necessary flexibility and elasticity.

From the top of the stem there projects a profiled element 31 which becomes inserted into the recess 30 when the stem is totally lowered into the pump; the profiled element is substantially complementary to the recess and when inserted into it, it minimizes the space present between the top of the rod and the stem.

A passage hole 32 is provided axially in the profiled element 31 and is connected to a dispensing hole 33 opening onto the outside of the pushbutton 21.

Figure 2:
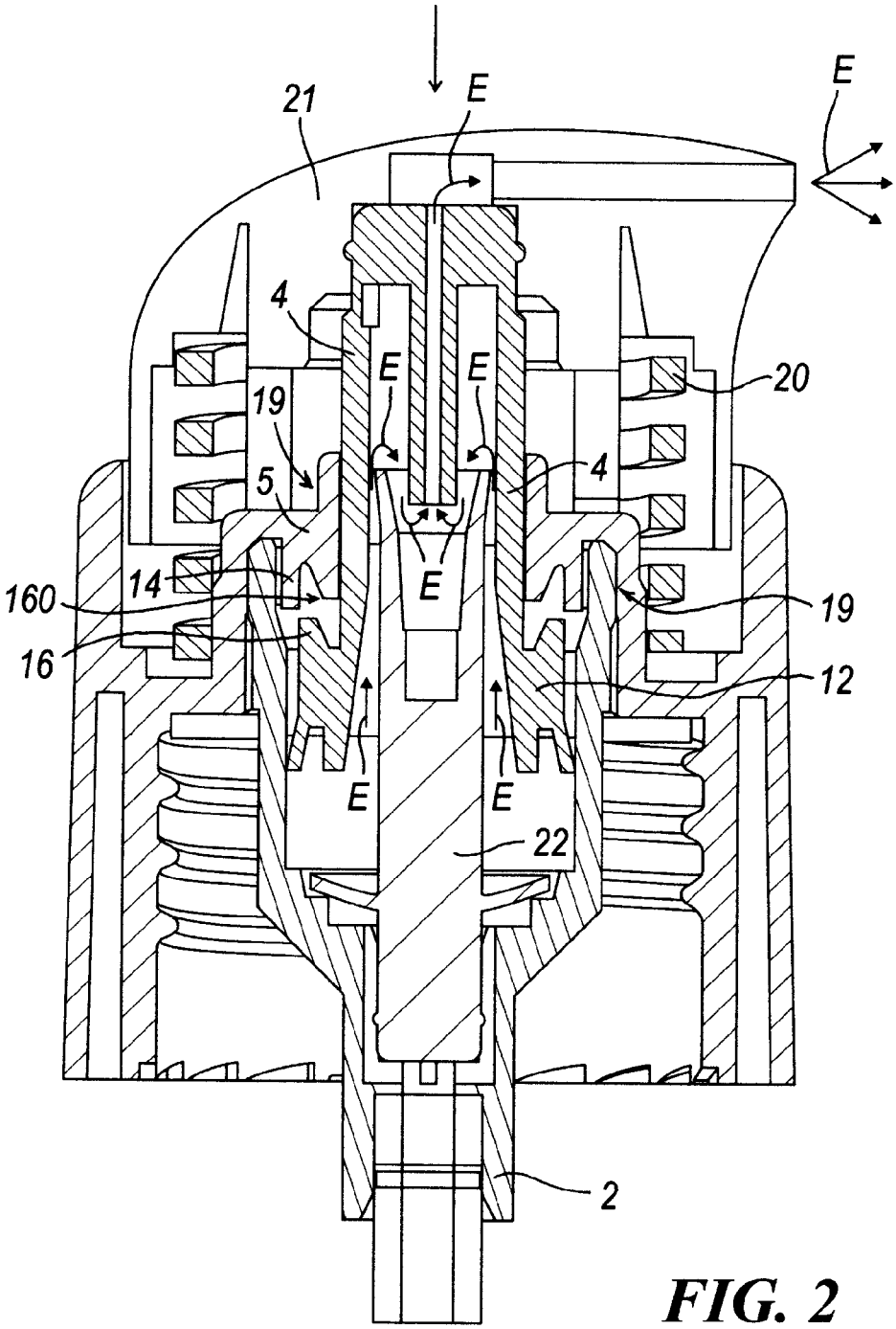
FIG. 2 is a lateral section through the pump in its compression and dispensing phase.

When the chamber 3 is pressurized by lowering the stem, and the pressure within it exceeds a predetermined threshold related to the flexibility of the lip 26, the lip flexes to allow fluid dispensing in the direction of the arrows E of FIG. 2.

The unidirectional valve 7 consists of a flexible discoidal piece 40 projecting from the surface of the rod 22 in proximity to its first end 22A and of a sharp-edged sealing surface 41 provided on the internal second end 2B of the cup-shaped body 2. The discoidal piece 40 prevents fluid passage from the chamber 3 to the tube 9 under rest or dispensing conditions.

The aforedescribed unidirectional valve 7, formed integrally with the rod 22, can be replaced by a conventional unidirectional ball valve commonly used in these types of pump. In this case the cup-shaped body 2 presents a housing for the ball and a surface against which it seals, above the ball there being provided the fins which retain the rod. The ball is movable in the housing.

Figure 3:
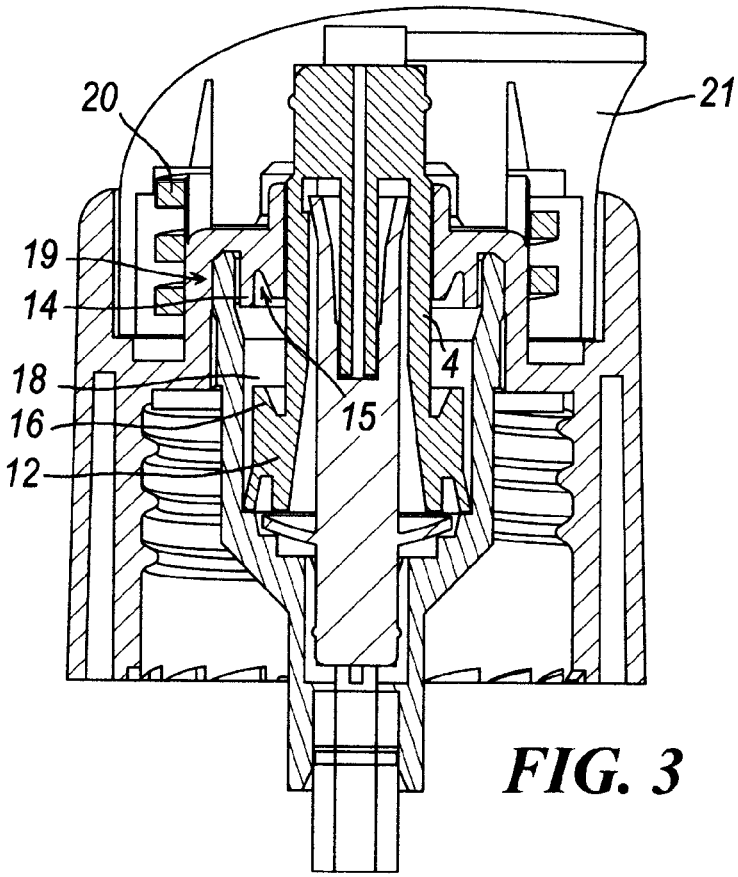
FIG. 3 is a lateral section through the pump in its priming phase.
Figure 3A:
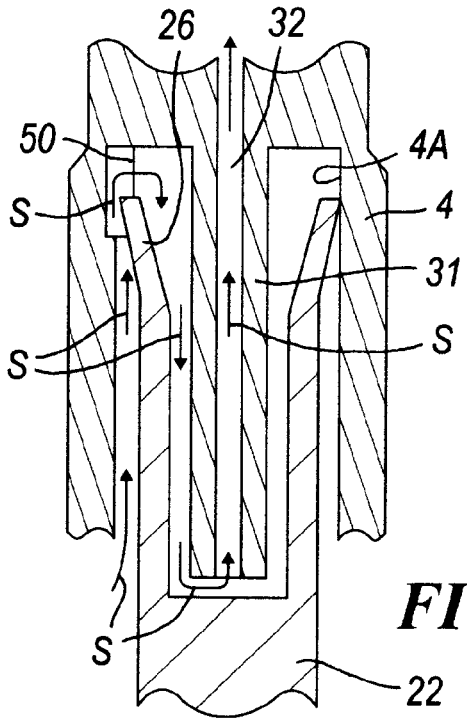
FIG. 3A shows an enlarged detail of FIG. 3.
Figure 4:
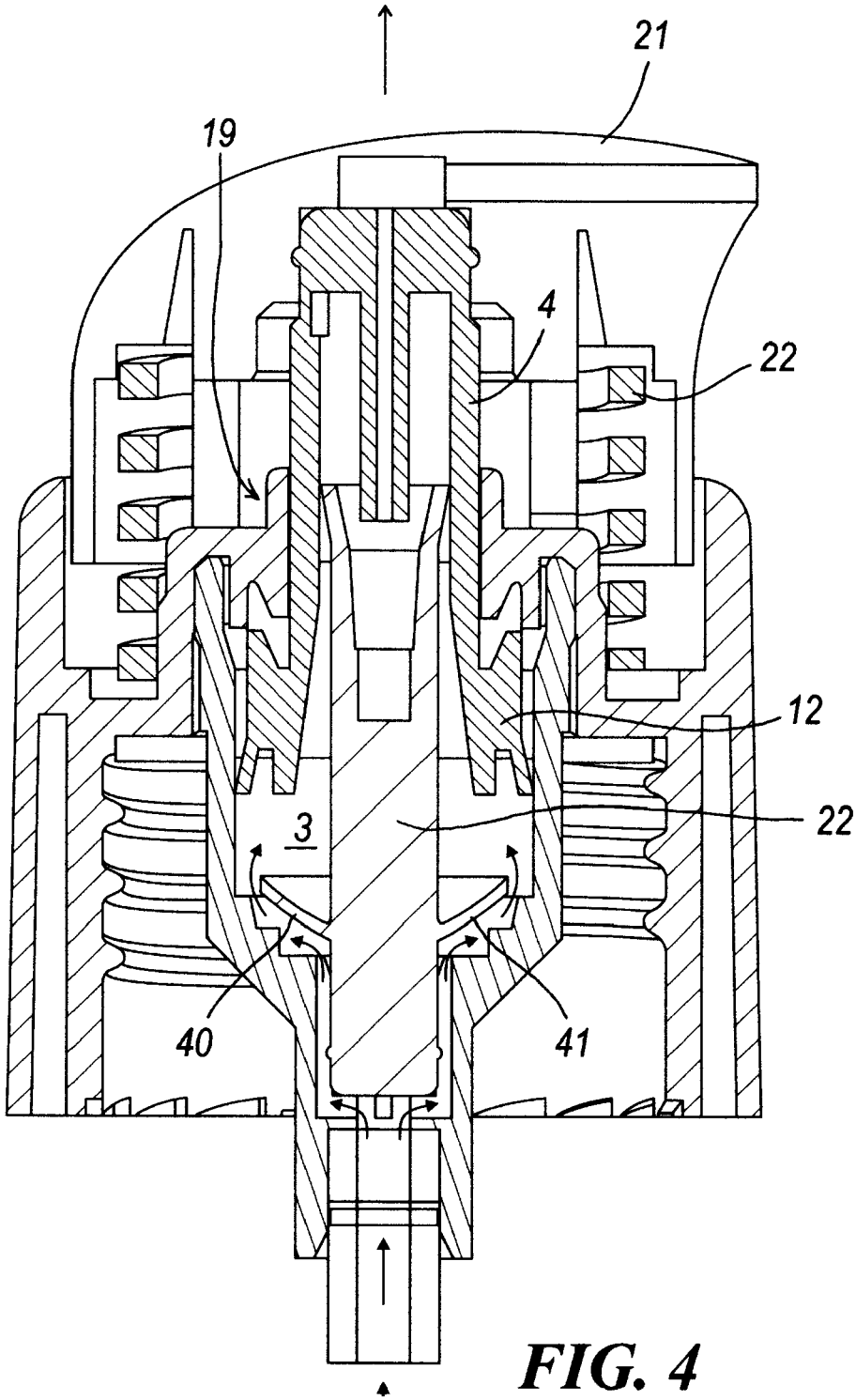
FIG. 4 is a lateral section through the pump in its intake phase.

At its second end the stem 4 presents a groove 50 provided in the inner surface 40 of the stem cavity. This groove is located in a position such as to cooperate with the projecting lip in such a manner as to open the valve 25 (FIG. 3A) when the piston 12 is pressed into its end of stroke position, to vent the compressed air in the cylindrical chamber 3 (arrows 5) when the pump is being primed.

This groove can be replaced by other priming means such as a raised portion projecting into the stem cavity. This raised portion must be located in a position such as to interfere with the projecting lip in order to open the valve when the piston is pressed into its end of stroke position. The cup-shaped body 2 can also present at its second end, inside the chamber, at least one raised portion arranged to interfere with the slidable piston in such a manner as to open its seal, when the piston is pressed into its end of stroke position.

Advantageously such a pump structure enables a very compact pump to be obtained, in particular of very small internal and external height

What I claim is:

1. A simplified pump for dispensing fluid substances withdrawn from a container of said substances, comprising a cup-shaped body defining a cylindrical chamber into which a hollow stem extends, an endpiece mounted on an open first end of the cup-shaped body, said cup-shaped body presenting at its second end a passage, sealedly closable by a unidirectional valve, and a seat for housing one end of a dip tube for withdrawing the fluid substance from the container, a piston sealedly slidable along the surface of the cylindrical chamber, said piston being rigid with said stem and being disposed in proximity to a first end of the stem within said chamber and projecting towards the inner surface of the cup-shaped body, the endpiece being provided both with a hole through which said stem emerges and by which it is guided, and with at least one element sealing against said piston, an elastic member which acts in the sense of urging said piston towards said endpiece, and a movable valve for closing a stem cavity, wherein positioned in the interior of the cup-shaped body there is an elongated rod, a first end of which projects below the unidirectional valve and is inserted into and retained in a seat provided at the second end of the cup-shaped body below the unidirectional valve, an intermediate portion of the rod having a cylindrical profile of diameter less than the diameter of said stem cavity into which said rod portion extends, said movable valve for closing the stem cavity comprising a continuous elastic lip projecting from a second end of the rod towards the outside of said cylindrical chamber, said lip being sealedly slidable in contact with the cylindrical surface of the stem cavity and expanding radially outward in a direction away from said cylindrical chamber, whereby pressure in the cylindrical chamber causes the lip to flex away from contact with the cylindrical surface of the stem cavity to relieve the pressure.

2. A pump as claimed in claim 1, wherein said lip defines a cavity at said second end of said rod.

3. A pump as claimed in claim 2, wherein from the top of the stem there projects a profiled element provided with a passage hole opening to the outside of the pump for dispensing a fluid substance, the profiled element being insertable into said cavity defined by the lip when the stem is totally lowered into the pump, said profiled element being substantially complementary to said cavity.

4. A pump as claimed in claim 1, wherein said unidirectional valve consists of a flexible discoidal piece projecting from the surface of said rod in proximity to the first end and of a sealing surface provided on the inner second end of the cup-shaped body, said discoidal piece preventing fluid passage under rest or dispensing conditions.

5. A pump as claimed in claim 4, wherein said sealing surface is sharp-edged.

6. A pump as claimed in claim 1, wherein an operating and dispensing pushbutton is fixed externally to the second end of said stem, said elastic member being positioned between said pushbutton and said endpiece.

7. A pump as claimed in claim 1, wherein said elastic member is a spring.

8. A pump as claimed in claim 1, wherein at its second end said stem presents at least one raised portion projecting into the interior of the stem cavity, said raised portion being situated in a position such as to interfere with said projecting lip in such a manner as to open said movable valve when the piston is pressed into its end of stroke position.

9. A pump as claimed in claim 1, wherein at its second end, said stem presents at least one groove provided in the inner surface of the stem cavity, said groove being situated in a position such as to cooperate with said projecting lip in such a manner as to open said movable valve when the piston is pressed into its end of stroke position.

10. A pump as claimed in claim 1, wherein said cup-shaped body presents at its second end, in the interior of the chamber, at least one raised portion arranged to interfere with the sliding piston such as to interrupt its seal, when the piston is pressed into its end of stroke position.

11. A pump as claimed in claim 1, wherein said endpiece is integral with a ring cap enabling said pump to be fixed onto said container.

12. A pump as claimed in claim 1, wherein said element of said endpiece sealing against said piston is annular and acts as a sealing stop for said piston when said piston is in its rest position.

13. A pump as claimed in claim 1, wherein said stem cavity presents a conical lead-in in proximity to its first end.

* * * * *